United States Patent [19]

Lang

[11] 3,976,261

[45] Aug. 24, 1976

[54] BELT-TYPE THREAD-SUPPLY APPARATUS

[75] Inventor: Erich Lang, Arbon, Switzerland

[73] Assignee: Evolution SA, Rorschach, Switzerland

[22] Filed: Oct. 7, 1975

[21] Appl. No.: 620,425

[30] Foreign Application Priority Data

Oct. 16, 1974 Germany ..... 2449267

[52] U.S. Cl. ..... 242/128; 242/75.41; 242/156.1; 57/106

[51] Int. Cl.[2] ..... B65H 59/04

[58] Field of Search ..... 57/59, 106; 242/45, 242/75, 75.1, 75.4, 75.41, 75.42, 75.43, 75.45, 75.46, 128, 156.1

[56] References Cited

UNITED STATES PATENTS

| | | | |
|---|---|---|---|
| 520,874 | 6/1894 | Black | 242/75.41 |
| 2,099,313 | 11/1937 | Potdevin | 242/75.41 |
| 2,155,771 | 4/1939 | Porter | 242/128 |
| 2,163,711 | 6/1939 | Selvig | 242/128 |
| 3,120,930 | 2/1964 | Forman et al. | 242/75.4 |
| 3,307,805 | 3/1967 | Verbeek | 242/156.1 X |
| 3,603,494 | 9/1971 | Ulmer | 242/75.41 X |

*Primary Examiner*—Donald E. Watkins
*Attorney, Agent, or Firm*—Karl F. Ross; Herbert Dubno

[57] ABSTRACT

A yarn package is supported on a horizontal spindle in a thread-supply apparatus and the thread is drawn horizontally away from the package. A flexible belt is hung from one end on a support rod displaceable toward and away from the spindle and extending parallel to the spindle. This belt is provided with a weight at its other end and is wrapped around the package completely with the weight hanging down past the support. This belt forms a thread-brake that ensures even tension in the filament being pulled from the package.

8 Claims, 10 Drawing Figures

BELT-TYPE THREAD-SUPPLY APPARATUS

FIELD OF THE INVENTION

The present invention relates to a yarn-supply apparatus. More particularly this invention concerns such an apparatus which feeds yarn from a package to an arrangement for twisting or spinning this yarn.

BACKGROUND OF THE INVENTION

A device is known having a horizontal support spindle for a yarn package. The yarn, by which is meant either a standard multi-filament yarn, a mono-filament, or other thread-like or filamentary strand, is drawn horizontally off the yarn package away from the support. It is necessary in such arrangements that thread brake be provided to maintain the yarn under a predetermined tension. As the yarn is pulled off for spinning and/or twisting the twist imparted to the yarn tensions it. When this tension is greater than the tension with which the yarn is braked the yarn may knot up and jam the apparatus.

Knotting up is also a problem when the yarn advance is stopped. When started up again also, the increasing tension is frequently insufficient to pull out the knots so that jamming is a problem. Various devices are known such as a so-called balloon braker which is intended to prevent this difficulty. It has been suggested even to apply a type of band brake to the yarn package itself. This type of system, however, has never been reduced to practice adequately and has always given poor results.

OBJECTS OF THE INVENTION

It is therefore an object of the present invention to provide an improved supply apparatus for filamentary material.

Yet another object is to provide such an apparatus which provides a very even braking force effective both when operating at high speed and on start-up of the system.

Another object is to provide such a system which always maintains substantially the same tension in the yarn being pulled off the package.

SUMMARY OF THE INVENTION

These objects are attained according to the present invention by providing a belt-brake type arrangement which engages substantially completely around the yarn package. Thus in accordance with the present invention a flexible belt having a pair of opposite faces and a pair of opposite ends and of a length greater than the circumference of the package is attached at one end to a horizontal support and carries at its other end a weight. This belt is wrapped around the package so that its inner face lies against the package and overlies its outer face adjacent the support which is itself displaceable toward and away from the spindle on which the yarn or filament package is supported.

This support according to the present invention is a rod along the end of the belt and extending beyond the sides thereof where it is connected at its ends to a pair of arms pivotal about a common axis above and parallel to the spindle support for the yarn package. The belt is wrapped around the yarn package in a direction opposite the direction in which the yarn is wound on the package so that it is automatically self-tightening, being pulled toward the package as the filament is pulled therefrom. The support rod is swingable within an area defined by a horizontal plane passing through the center of the spindle and lying on the axis thereof and another plane extending upwardly through this axis at an angle of 45° to the first-mentioned plane. Thus the support rod always lies against the surface of the filament package.

In accordance with the present invention the two arms form a U-shaped frame on which the support rod is carried and themselves pivot on a rod extending parallel to the spindle and lockable at any of several positions around this spindle so as to compensate for different yarn package diameters and directions of winding of the yarn thereon.

The belt according to the present invention may be made of knitted or woven fabric, paper, glass-fiber foil, synthetic-resin sheeting or the like. The package may be cylindrical or even somewhat conical, as in both cases the braking effect with the belt will be the same.

It is also within the scope of this invention to provide biasing means in the form of a tension spring or the like so as tightly to pull the belt around the yarn package. Such a spring may be hooked between the rod provided at the one end of the belt and constituting the weight and a fixed object.

BRIEF DESCRIPTION OF THE DRAWING

The above and other objects, features, and advantages will become more readily apparent from the following, reference being made to the accompanying drawing in which.

SPECIFIC DESCRIPTION

Figure 1A:
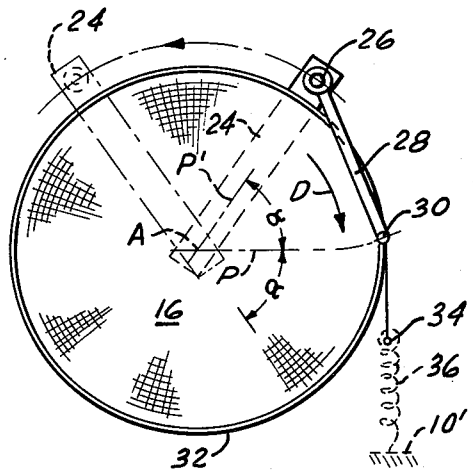
FIGS. 1 and 1*a* are side and end views of the system according to the present invention with a yarn package in place.
Figure 1:
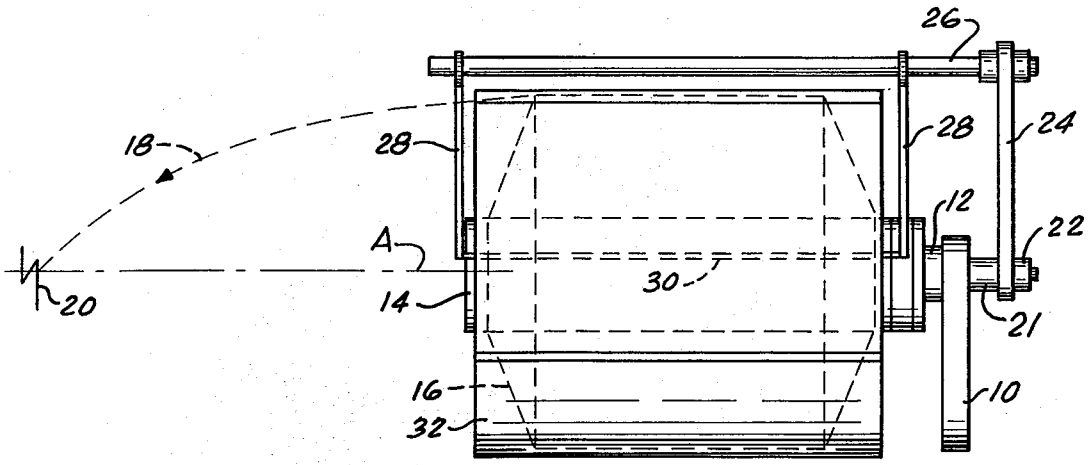
Figure 2A:
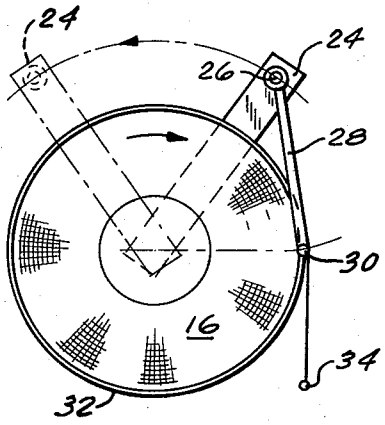
FIGS. 2 and 2*a*, 3 and 3*a*, and 4 and 4*a* are views similar to FIGS. 1 and 1*a*, respectively, and show the arrangement in consecutively advanced stages of unwinding the package.
Figure 2:
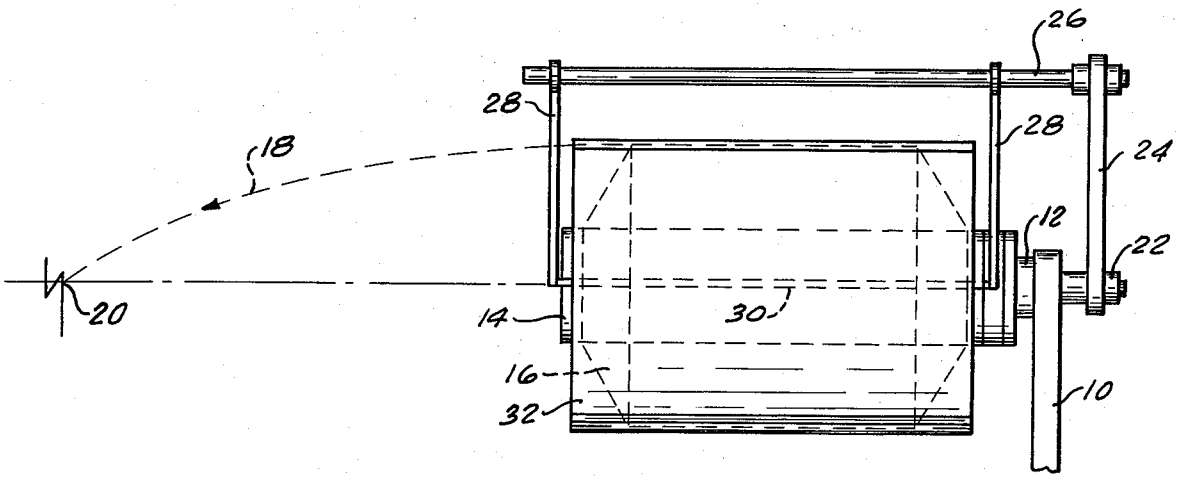
Figure 3A:
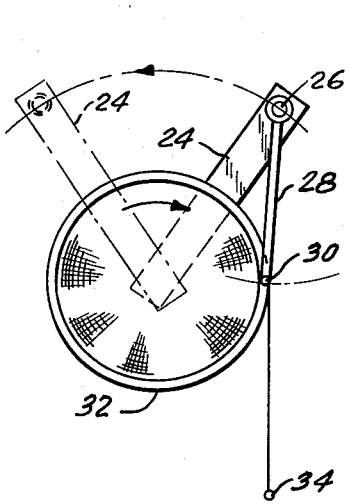
Figure 3:
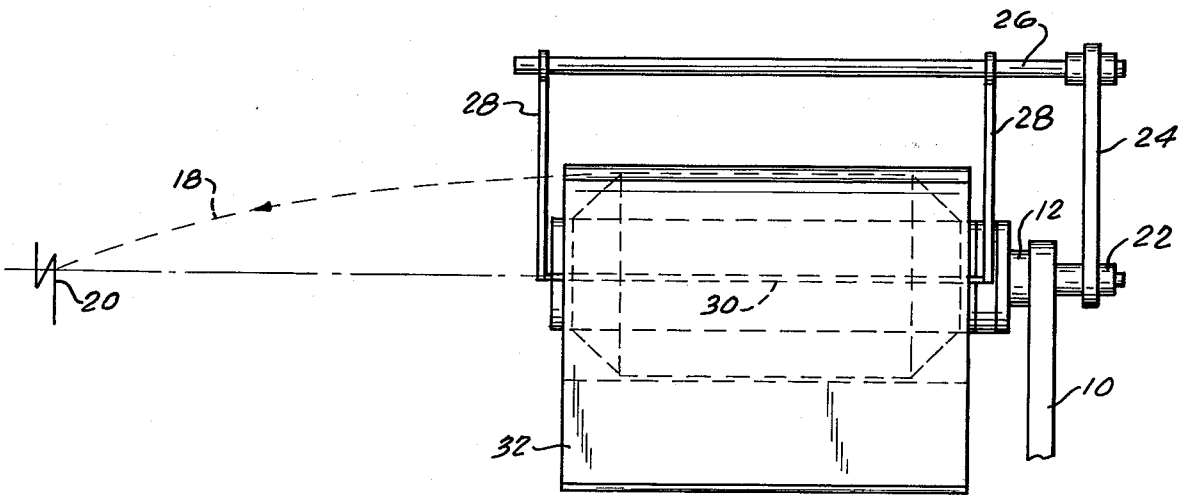
Figure 4A:
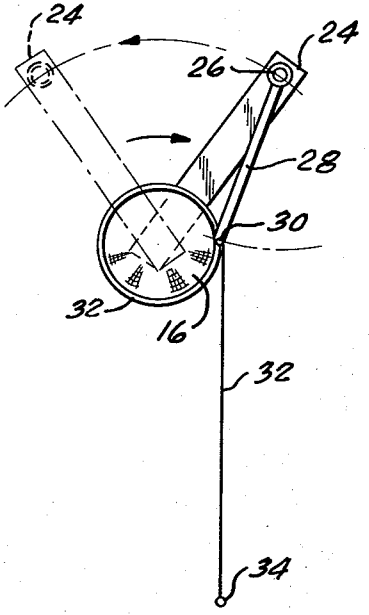
Figure 4:
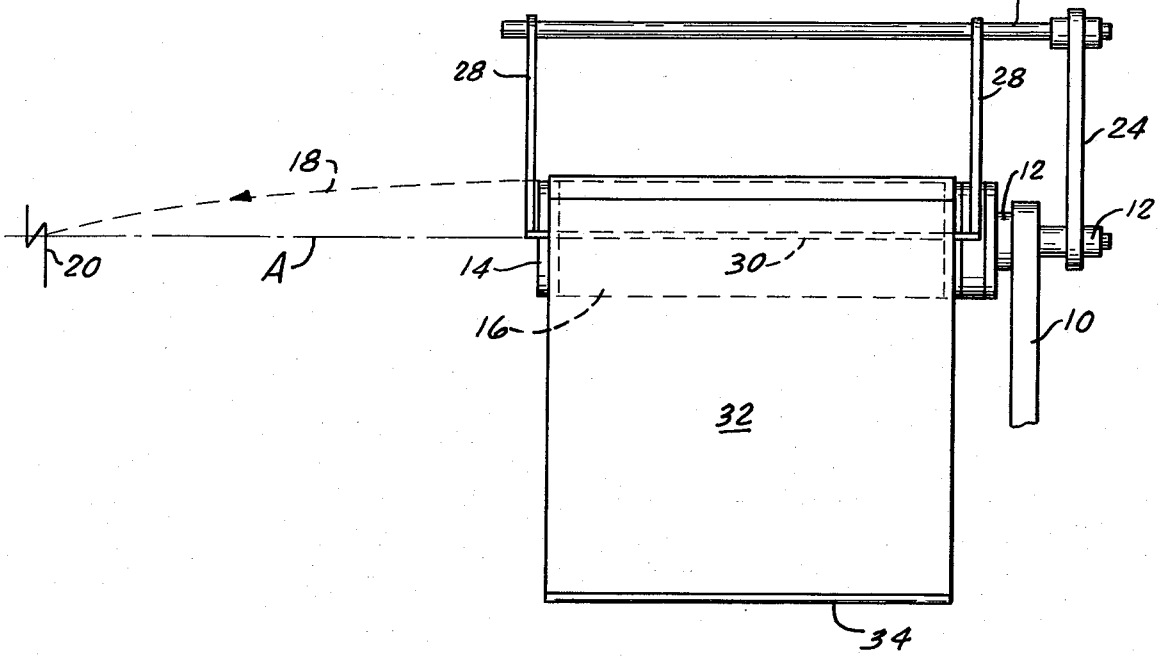

The arrangement shown in FIGS. 1 and 1*a* comprises a support spindle 12 mounted on a rigid frame 10 and defining an axis A. A cylindrical core 14 of a yarn package 16 is fitted over this shaft 12 and a filament 18 is pulled therefrom through a guide 20 lying on the axis A horizontally in line with the center of the package 16.

To the side of this frame 10 opposite the spindle 12 there is provided an axial extension 21 carrying a nut 22 which locks a radially extending arm 24 in place thereon. Extending parallel to the axis A from the far end of the arm 24 is a rod 26 from which depend a pair of arms between whose lower ends extends a rod 30. A belt 32 has one end formed with a pocket through which the rod 30 passes and another end formed with a pocket in which is provided a rod 34 constituting a weight.

As shown in FIG. 1 the belt 32 is normally wrapped around the package 16 in a direction D opposite the direction in which the filament 18 is wound on the package 16, and identical to the direction in which the filament 18 will be pulled off this package 16. The weighted end of the belt 34 hangs down past the rod 30 and may additionally be secured to a fixed point 10' by means of a spring 36 shown in dot-dash lines in FIG. 1*a*.

As also illustrated in FIG. 1*a* the rod 30 is suspended so as to be displaceable within an arc defined between a horizontal plane P passing through the axis A and another plane P′ extending upwardly at an angle $\alpha$ of 45° through the axis A. As the filament 18 is pulled off the package 16 it will therefore pull the belt 32 tight around the package to tension this filament 18 evenly. The belt 32 lies against the entire outer surface of the package 16.

When the filament 18 is wound in the package 16 in the opposite direction the nut 22 is loosened and the arm 24 is swung into the position shown in dot-dash lines in FIGS. 1*a* and the belt is wound in the opposite direction around the package 16. Though this other position is mirror symmetrical to the solid-line position in 1*a*, with a vertical plane passing through the axis A being the symmetry plane.

FIGS. 2–4*a* indicate how, as the package diameter decreases, the belt 32 remains in snug contact with the entire outside of the package 16 and how the support rod 30 follows the periphery inward.

Figure 5A:
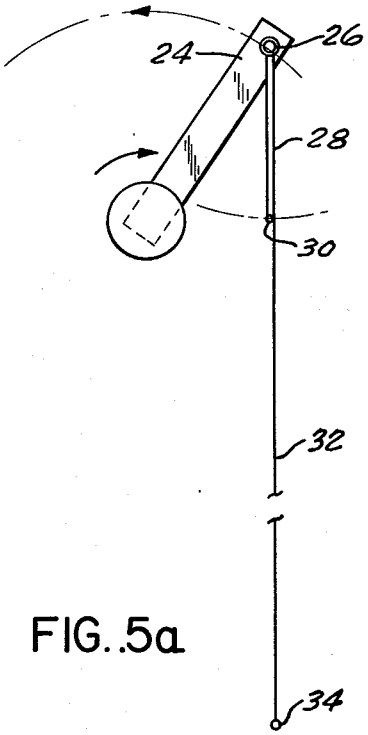
FIGS. 5 and 5*a* are views similar to FIGS. 1 and 1*a* showing the assembly before mounting of a yarn package thereon.
Figure 5:
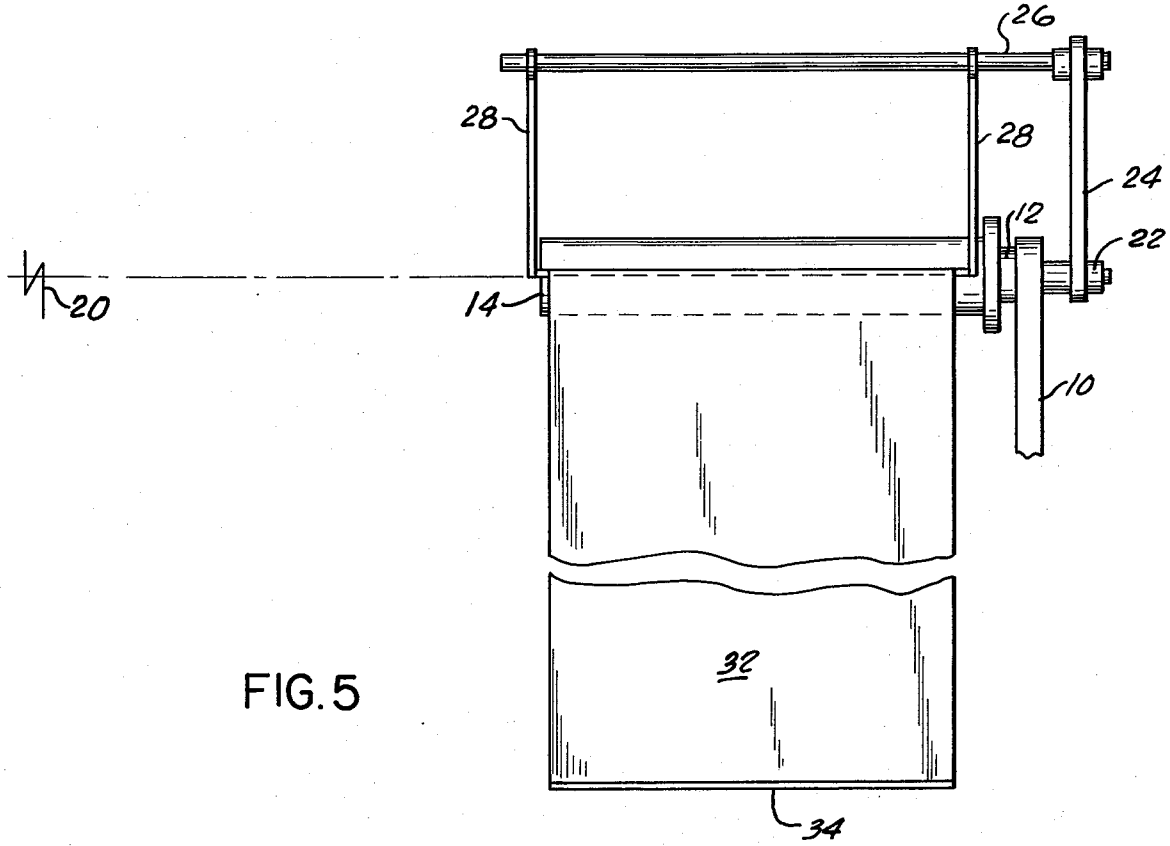

In FIGS. 5 and 5*a* the device is shown in the position it is in prior to mounting of a yarn package on the spindle 14 and wrapping of the belt 32 around the package.

I claim:

1. A thread-supply apparatus comprising:

a horizontal spindle for supporting a yarn package, a guide for withdrawal of a thread horizontally from said package on said spindle, a flexible belt having a pair of opposite faces and a pair of opposite ends and of a length greater than the circumference of said package, a weight at one of said ends of said belt, and means including a horizontal support secured to the other end of said belt and displaceable toward and away from said spindle for holding said belt with said inner face wrapped around said package and overlying said outer face at least adjacent said support.

2. The apparatus defined in claim 1 wherein said means includes a pair of arms each having one end secured to said support and another end pivotal about an axis parallel to and above said spindle.

3. The apparatus defined in claim 2 wherein said support is a rod extending parallel to said spindle and displaceable relative thereto in an area defined between a horizontal plane passing through said spindle and another plane passing up through said spindle at an angle of 45° to said horizontal plane.

4. The apparatus defined in claim 2, further comprising means for displacing said axis horizontally relative to said spindle.

5. The apparatus defined in claim 4 wherein said means for displacing includes an arm having one end secured to said spindle and another end carrying a rod on which said arms are journaled.

6. The apparatus defined in claim 2 wherein said weight is a rod at said one end.

7. The apparatus defined in claim 1 wherein said package is generally cylindrical.

8. The apparatus defined in claim 1, further comprising means for pulling said one end downwardly with a predetermined biasing force.

* * * * *